US010854046B2

(12) United States Patent
Capps

(10) Patent No.: US 10,854,046 B2
(45) **Date of Patent: *Dec. 1, 2020**

(54) SYSTEMS AND METHODS FOR CASH PAYMENTS FOR ONLINE GAMING USING LOCATION

(71) Applicant: Handle Financial, Inc., Sunnyvale, CA (US)

(72) Inventor: Stephen Capps, San Carlos, CA (US)

(73) Assignee: Handle Financial, Inc., Sunnyvale, CA (US)

( * ) Notice: Subject to any disclaimer, the term of this patent is extended or adjusted under 35 U.S.C. 154(b) by 62 days.

This patent is subject to a terminal disclaimer.

(21) Appl. No.: 16/232,578

(22) Filed: Dec. 26, 2018

(65) Prior Publication Data

US 2019/0130695 A1 May 2, 2019

Related U.S. Application Data

(63) Continuation of application No. 14/594,565, filed on Jan. 12, 2015, now Pat. No. 10,192,407.

(60) Provisional application No. 61/925,957, filed on Jan. 10, 2014.

(51) Int. Cl.
*G07F 17/32* (2006.01)

(52) U.S. Cl.
CPC ..... *G07F 17/329* (2013.01); *G07F 17/3237* (2013.01); *G07F 17/3246* (2013.01)

(58) Field of Classification Search
CPC . G07F 17/329; G07F 17/3237; G07F 17/3246
See application file for complete search history.

(56) References Cited

U.S. PATENT DOCUMENTS

| | | | |
|---|---|---|---|
| 4,799,156 | A | 1/1989 | Shavit et al. |
| 5,056,019 | A | 10/1991 | Schultz et al. |
| 5,308,119 | A | 5/1994 | Roshkoff |
| 5,310,997 | A | 5/1994 | Roach et al. |
| 5,336,870 | A | 8/1994 | Hughes et al. |
| 5,577,109 | A | 11/1996 | Stimson et al. |

(Continued)

OTHER PUBLICATIONS

MODASolutions (2007)"A Look at How Online Bill Payment Changes the eCommerce Landscape" A MODASolutionsTM White Paper, pp. 1-14.

(Continued)

*Primary Examiner* — Werner G Garner
(74) *Attorney, Agent, or Firm* — Loza & Loza, LLP; Gordon R. Lindeen, III

(57) ABSTRACT

Disclosed herein are systems and methods for facilitating cash payment for online gaming including receiving player information at a service provider system through an input element of a player input screen presented on a player system. Embodiments include presenting information regarding a point-of-service that is equipped to accept cash payments, generating a token that is optically readable for use by the point-of-service, determining if the point-of-service is located in a geographic region authorized to make payments to the game provider; and notifying the point-of-service to reject any payments from the player system if the point-of-service is not located in a geographic region authorized to make the payments from the player system to the game provider.

20 Claims, 5 Drawing Sheets

(56) References Cited

U.S. PATENT DOCUMENTS 5,594,226 A 1/1997 Steger
5,721,768 A 2/1998 Stimson et al.
5,924,080 A 7/1999 Johnson
5,956,894 A 9/1999 Powell
5,970,470 A 10/1999 Walker et al.
6,055,516 A 4/2000 Johnson et al.
6,070,798 A 6/2000 Nethery
6,141,653 A 10/2000 Conklin et al.
6,185,545 B1 2/2001 Resnick et al.
6,260,024 B1 7/2001 Shkedy
6,266,647 B1 7/2001 Fernandez
6,356,878 B1 3/2002 Walker et al.
6,381,582 B1 4/2002 Walker et al.
6,450,407 B1 9/2002 Freeman et al.
6,581,827 B2 6/2003 Welton
6,736,314 B2 5/2004 Cooper et al.
6,745,022 B2 6/2004 Knox
6,837,426 B2 1/2005 Tidball et al.
6,938,013 B1 8/2005 Gutierrez-Sheris
6,971,574 B1 12/2005 Herskowitz
7,006,983 B1 2/2006 Packes, Jr. et al.
7,042,992 B1 2/2006 Falcone
7,035,813 B1 4/2006 Cook
7,243,839 B2 7/2007 Beck et al.
7,290,704 B1 11/2007 Ball et al.
7,293,109 B2 11/2007 Maximillian
7,296,003 B2 11/2007 Mersky et al.
7,344,067 B2 3/2008 Beck et al.
7,386,485 B1 6/2008 Mussman et al.
7,422,153 B2 9/2008 Cai
7,473,179 B2 * 1/2009 Xidos ..... G07F 17/32 463/29
7,611,051 B1 11/2009 Beck et al.
7,640,193 B2 12/2009 Crespo et al.
7,711,639 B2 5/2010 Reid et al.
7,729,984 B1 6/2010 Nappi
7,783,571 B2 8/2010 Fish et al.
7,797,192 B2 9/2010 Mitchell et al.
7,904,385 B2 3/2011 Bishop et al.
7,949,600 B1 5/2011 Portillo et al.
8,060,382 B1 11/2011 Lee et al.
8,140,381 B1 3/2012 Wu et al.
8,282,001 B2 10/2012 Snyder et al.
8,371,502 B1 2/2013 Galit et al.
8,392,208 B1 3/2013 Klieman et al.
8,605,094 B1 12/2013 Alfaro et al.
8,651,374 B2 2/2014 Brabson et al.
8,681,741 B1 3/2014 Ngo et al.
2001/0032182 A1 10/2001 Kumar et al.
2001/0042042 A1 11/2001 Stokes et al.
2002/0002537 A1 1/2002 Bastiansen
2002/0010600 A1 1/2002 Fujita
2002/0013768 A1 1/2002 Ganesan
2002/0077978 A1 6/2002 O'Leary et al.
2002/0147689 A1 10/2002 Falkner
2002/0152163 A1 10/2002 Bezos et al.
2002/0153410 A1 10/2002 Santini
2002/0161644 A1 10/2002 Duffield
2002/0161721 A1 10/2002 Yuan et al.
2002/0188559 A1 12/2002 Schultz
2002/0195486 A1 12/2002 Erb et al.
2003/0046223 A1 3/2003 Crawford et al.
2003/0061162 A1 3/2003 Matthews
2003/0149632 A1 8/2003 Walker et al.
2003/0154165 A1 8/2003 Horn et al.
2003/0220862 A1 11/2003 Kilgore et al.
2004/0024701 A1 2/2004 Hansen et al.
2004/0024707 A1 2/2004 Perre et al.
2004/0030647 A1 2/2004 Hansen et al.
2004/0035922 A1 2/2004 Cameron
2004/0133515 A1 7/2004 McCoy et al.
2004/0139009 A1 7/2004 Kozee et al.
2004/0185869 A1 9/2004 Lee et al.
2004/0210476 A1 10/2004 Blair et al.
2004/0249705 A1 12/2004 Spencer et al.
2005/0108104 A1 5/2005 Woo
2005/0125345 A1 6/2005 Miller et al.
2005/0137970 A1 6/2005 Houle et al.
2005/0182684 A1 8/2005 Dawson et al.
2005/0256806 A1 11/2005 Tien et al.
2006/0054695 A1 3/2006 Owada
2006/0136301 A1 6/2006 Grovit
2006/0167791 A1 7/2006 Hahn-Carlson
2006/0173776 A1 8/2006 Shalley et al.
2006/0253335 A1 11/2006 Keena
2007/0016523 A1 1/2007 Blair et al.
2007/0016526 A1 1/2007 Hansen et al.
2007/0022058 A1 1/2007 Labrou et al.
2007/0038516 A1 2/2007 Apple et al.
2007/0130028 A1 6/2007 Provinse
2007/0150411 A1 6/2007 Addepalli et al.
2007/0150414 A1 6/2007 Templeton
2007/0174082 A1 7/2007 Singh
2007/0225912 A1 9/2007 Grush
2007/0243934 A1 * 10/2007 Little ..... G07F 17/3213 463/40
2007/0252696 A1 11/2007 Belisle et al.
2008/0021841 A1 1/2008 Rau et al.
2008/0040233 A1 2/2008 Wildman et al.
2008/0097904 A1 4/2008 Volchek et al.
2008/0162345 A1 7/2008 Passanha
2008/0215475 A1 9/2008 Ramer et al.
2008/0275811 A1 11/2008 Koningstein et al.
2008/0301047 A1 12/2008 Fish et al.
2008/0319869 A1 12/2008 Carlson et al.
2009/0012862 A1 1/2009 Pirillo et al.
2009/0017798 A1 1/2009 Pop
2009/0048886 A1 2/2009 Bishop et al.
2009/0055266 A1 2/2009 Brody et al.
2009/0112662 A1 4/2009 Mullen et al.
2009/0112760 A1 4/2009 Johnson et al.
2009/0150290 A1 6/2009 Szrek et al.
2009/0157566 A1 6/2009 Grush
2009/0187492 A1 7/2009 Hammad et al.
2009/0204522 A1 8/2009 Johnh
2009/0222317 A1 9/2009 Allen et al.
2009/0228336 A1 9/2009 Giordano et al.
2009/0234746 A1 9/2009 Jensen et al.
2009/0240594 A1 9/2009 Kerner et al.
2009/0254381 A1 10/2009 Frederickson et al.
2009/0313109 A1 12/2009 Bous et al.
2009/0327133 A1 12/2009 Aharoni et al.
2010/0005025 A1 1/2010 Kumar et al.
2010/0017279 A1 1/2010 Connor, Jr.
2010/0138344 A1 6/2010 Wong et al.
2010/0145723 A1 6/2010 Hudson et al.
2010/0174646 A1 7/2010 Cole et al.
2010/0191578 A1 7/2010 Tran et al.
2010/0205167 A1 8/2010 Tunstall-Pedoe et al.
2010/0223182 A1 9/2010 Battaglini
2010/0257081 A1 10/2010 Ritchie
2010/0268821 A1 10/2010 Pau et al.
2010/0276484 A1 11/2010 Banerjee et al.
2010/0332265 A1 12/2010 Smith
2011/0125561 A1 5/2011 Marcus
2011/0131118 A1 6/2011 Srinivasan et al.
2011/0145145 A1 6/2011 Battaglini et al.
2011/0201430 A1 * 8/2011 Maribona ..... G07F 17/32 463/42
2011/0208550 A1 8/2011 Lamarche et al.
2011/0208641 A1 8/2011 Shader et al.
2011/0208642 A1 8/2011 Shader et al.
2011/0213699 A1 9/2011 Johnson
2011/0225067 A1 9/2011 Dunwoody
2011/0238474 A1 9/2011 Carr et al.
2011/0258122 A1 10/2011 Shader et al.
2011/0258686 A1 10/2011 Raj et al.
2011/0276474 A1 11/2011 Portillo et al.
2012/0005075 A1 1/2012 Bulawa et al.
2012/0030110 A1 2/2012 Prakash et al.
2012/0041877 A1 2/2012 Rao
2012/0066081 A1 3/2012 Shader et al.
2012/0072346 A1 3/2012 Barkan Daynovsky et al.
2012/0084178 A1 4/2012 Ehbauer et al.

(56) References Cited

U.S. PATENT DOCUMENTS

| | | | | |
|---|---|---|---|---|
| 2012/0129552 | A1 | 5/2012 | Skybey | |
| 2012/0130797 | A1 | 5/2012 | Shin | |
| 2012/0166314 | A1 | 6/2012 | Kimberg | |
| 2012/0179558 | A1 | 7/2012 | Fischer | |
| 2012/0185317 | A1 | 7/2012 | Wong | |
| 2012/0209767 | A1 | 8/2012 | Battaglini et al. | |
| 2013/0006785 | A1 | 1/2013 | Perkins et al. | |
| 2013/0030995 | A1 | 1/2013 | O'Leary et al. | |
| 2013/0041741 | A1 | 2/2013 | Shader et al. | |
| 2013/0046691 | A1 | 2/2013 | Culton | |
| 2013/0080239 | A1 | 3/2013 | Okerlund | |
| 2013/0124410 | A1 | 5/2013 | Kay et al. | |
| 2013/0138583 | A1 | 5/2013 | Gilder et al. | |
| 2013/0166398 | A1 | 6/2013 | Minde | |
| 2014/0012688 | A1 | 1/2014 | McGuinness et al. | |
| 2014/0052654 | A1 | 2/2014 | Curelti et al. | |
| 2014/0094285 | A1* | 4/2014 | Sanford ..... | G07F 17/3227 463/25 |
| 2014/0095481 | A1 | 4/2014 | Argue et al. | |
| 2014/0108201 | A1 | 4/2014 | Frechelte et al. | |
| 2014/0122337 | A1 | 5/2014 | Kang | |
| 2014/0279111 | A1 | 9/2014 | Mahaffey et al. | |
| 2014/0279509 | A1 | 9/2014 | Khilnani et al. | |

OTHER PUBLICATIONS

"Cash payment comes to internet retailing." Accessed at http://www.internetretailer.com/internet/marketing conference/56525-cash-payment-come, Jun. 18, 2009. (pp. 1-2).

"Amazon debuts Honor System," Accessed at http://new.cnet.com/2100-1017-252122.html. Feb. 6, 2001, (pp. 1-4).

"Amazon Payments Account Management." Accessed at https://paymetns.amazon.com/sdui/sdui/business?sn=devfps/marketplace. Jun. 18, 2009. (pp. 1-4).

"PayNearMe at Finovate 2010" retrieved on May 7, 2015 from https://www.youtube.com/watch?v=d-oaZpczpqk (Oct. 4-5, 2010); posted Nov. 5, 2010; see arrow on screen referring to the publication date of this electronic reference, the publication date of Nov. 5, 2010 being a date more than one year prior to the filing of the instant application; the Prese.

"Inside Redbox Mobile Demo" (Feb. 1, 2009), uploaded to YouTube by habdeira, retrieved on Sep. 12, 2012 from: http://www.youtube.com/watch?v=iroan2BtzDc (hereinafter "Redbox App").

"PCT Search Report and Written Opinion", PCT/US2013/041974, (dated Aug. 14, 2013), 11 pages.

PayNearMe Demonstration Video; http://www.paynearme.com/greyhound; Apr. 2012.

"PayNearMe at FinovateFall 2010" retrieved on Sep. 12, 2012 from http://www.youtube.com/watch?v=d-oaZpCzpqk (Oct. 4-5, 2010; the Presenters are: CEO Danny Shader and Named inventor John Minor; also found on Assignee's website of www.paynearme.com, retrieved from: http://liveweb,archive.org/http://www.paynearme.com/consumers).

Coggins, Wynn W. (2002). Prior Art in the Field of Business Method Patents—When is an Electronic Document a Printed Publication for Prior Art Purposes? Presented at AIPLA, Fall 2002.

Plymouth, K. & Martin, J. (2009). Bill Payment Trends: Major Shifts in Consumer Behavior Require Comprehensive Planning. A First Data White Paper.

Rao, L. (2010). PayNearMe Launches Cash Payment System With 7-Eleven; Signs Up Amazon, Facebook, Disrupt, TechCruch.

Credit Card Processing Blog (Aug. 12, 2010), How to Manage 'Non-Matching Account Number' Chargebacks (hereinafter "Credit Card Processing").

PayNearMe at FinovateFall 2010 (2010), uploaded to youtube.com on Nov. 5, 2010 Herinalter PayNearMe2010).

Dealer Incentives, by Tim Gutowski, http://www.cars.com/go/advice/Story.jsp?section=inc&story=IncDealer&subject=incent, verfied by internet Archive WayBack Machine Apr. 27, 2005.

Channel Loyalty Program, htto://www.awards.co.za/what-we-do/sale-channel-incentive-programs/channel-loyalty-program/, Achievement Awards Group, verified by Internet Archive WayBack Machine May 12, 2013.

Dao et al. Location-Based services: technical and business issues. School of Surbeying and Spatial Information Systems, The University of New South Wales, Sydney, Australia, GPS Solutions (2002) 6: 169-178.

* cited by examiner

301

303

SYSTEMS AND METHODS FOR CASH PAYMENTS FOR ONLINE GAMING USING LOCATION

CROSS-REFERENCE TO RELATED APPLICATIONS

This application claims the benefit of U.S. Provisional Application No. 61/925,957, filed Jan. 10, 2014 and is a continuation of U.S. patent application Ser. No. 14/594,565 filed Jan. 12, 2015, the priority of which is also hereby claimed.

BACKGROUND

In the mid-1990s, the first online monetary-game providers were established. These game providers gained popularity throughout the decade. Internet gaming websites increased from just 15 in 1996, to 200 in 1997. Online gaming revenues exceeded $830 million in 1998 alone. That same year, the first online poker rooms were introduced. And in 1999, multiplayer online gaming was also introduced.

By 2001, the estimated number of people who had participated in online gaming was 8 million. In 2006 the number of people who gamed online was estimated to be between 14 million and 23 million. And in 2008, worldwide online gaming revenue were estimated at $21 billion.

The Internet has allowed wider access to traditional games, has allowed for new types of gaming, and has changed betting habits. Internet gaming has become one of the most popular and lucrative business present on the Internet. This is partly due to the wide range of gaming options that are available. This wide range of gaming options includes those listed below.

Poker—Online poker includes Texas hold 'em, Omaha, Seven-card stud, razz, HORSE and other game types in both tournament and ring game structures. Players play against each other rather than the "house" with the game provider making its money through "rake" and through tournament fees.

Casinos—There are a large number of online casinos in which people can play casino games such as roulette, blackjack, pachinko, baccarat and many others. These games are played against the "house" which makes money due to the fact that the odds are in its favor.

Sports betting—Sports betting is the activity of predicting sports results and placing a wager on the outcome.

Bingo—Online bingo is the game of bingo played on the Internet.

Lotteries—Most lotteries are run by governments and are heavily protected from competition due to their ability to generate large taxable cash flows. The first online lotteries were run by private individuals or companies and licensed to operate by small governments. Most private online lotteries have stopped trading as governments have passed new laws giving themselves and their own lotteries greater protection. Government controlled lotteries now offer their games online. U.S. lotteries are generally heavily regulated by individual state laws.

Horse racing betting—Horse racing betting comprises a significant percentage of online gaming wagers and all major Internet bookmakers, betting exchanges, and sports books offer a wide variety of horse racing betting markets.

Mobile gaming—Mobile gaming refers to playing games of chance or skill for money by using a remote device such as a tablet computer, smartphone or a mobile phone with a wireless internet connection.

In-Play gaming—In-Play gaming is a feature on many online sports betting websites that allows the user to bet while the event is in progress. A benefit of live in-play gaming is that there are a wide variety of markets. For example, in soccer a user could bet on which player will receive the next yellow card, or which team will be awarded the next corner kick.

Online gaming is heavily regulated in the United States. In September 2006, Congress passed the Unlawful Internet Gaming Enforcement Act of 2006 ("UIGEA") to make transactions from banks or similar institutions to online gaming sites illegal. The Act was signed into law on Oct. 13, 2006, by President George W. Bush. Subsequent bills have been introduced that would modify UIGEA by providing provisions for licensing Internet gaming facilities.

Other bills have been introduced that focus solely on online poker and would create uniform standards. Among other things, these bills would mandate steps that would limit underage access to online poker, protect consumers from fraud and preserve some state rights and revenues related to the activities. Many of these bills would prohibit the use of credit cards to fund the accounts of online poker players.

In 2010, the New Jersey expressly legalized certain forms of online gaming. New Jersey allows bets to be taken by in-State companies on poker games, casino games and slots. The law excludes sports betting but allows for sports betting to be potentially regulated separately. States including Delaware and Nevada have also taken steps to legalize forms of online gaming. All states that allow online gaming currently only allow people within their borders to use their computers to play online at state-sanctioned websites. The states that allow gaming are also exploring agreements with the other states that approve online gaming so that bettors can play the games across state lines. An important aspect of the negotiations between the states is how to track the location of the gamer and how to divide revenues between the states.

Funds for online gaming can come from credit cards, electronic checks, certified checks, money orders, or even wire transfers. Normally, gamers upload funds to an online gaming company, make bets or play the games that it offers, and then cash out any winnings Gamers may be able to fund gaming accounts by credit card or debit card, and cash out winnings directly back to the card. Most U.S. banks, however, prohibit the use of their credit cards for Internet gaming, and attempts by Americans to use credit cards at Internet gaming sites are usually rejected. Moreover, current laws prohibit the use of credit cards to purchase state lottery tickets, and many retailers prohibit the use of debit cards to buy lottery tickets or strictly limit their use. Some electronic money services offer accounts with which online gaming can be funded; however, many such fund-transfer sites such have discontinued service for U.S. residents.

SUMMARY

Disclosed herein are systems and methods for facilitating cash payment for online gaming including receiving player information at a service provider system through an input element of a player input screen presented on a player system. Embodiments include presenting information regarding a point-of-service that is equipped to accept cash payments, generating a token that is optically readable for use by the point-of-service, determining if the point-of-service is located in a geographic region authorized to make payments to the game provider; and notifying the point-of-service to reject any payments from the player system if the point-of-service is not located in a geographic region authorized to make the payments from the player system to the game provider.

BRIEF DESCRIPTION OF THE FIGURES

Together with this written description, the figures further serve to explain the principles of, and to enable a person skilled in the relevant art, to make and use the claimed systems and methods.

DETAILED DESCRIPTION

The present invention provides systems and methods to facilitate cash payments for online gaming that overcome many of the difficulties of the current system. For example, the systems and methods of the present invention may assist a player of an online game to make cash payments to a remote game provider and may help the player and game provider comply with state and federal gaming regulations. The following is a description of one or more embodiments of the present invention, with reference to FIGS. 1-5. The present invention is not limited to the particular embodiments described, and the terminology used herein is for the purpose of describing particular embodiments only.

Figure 1:
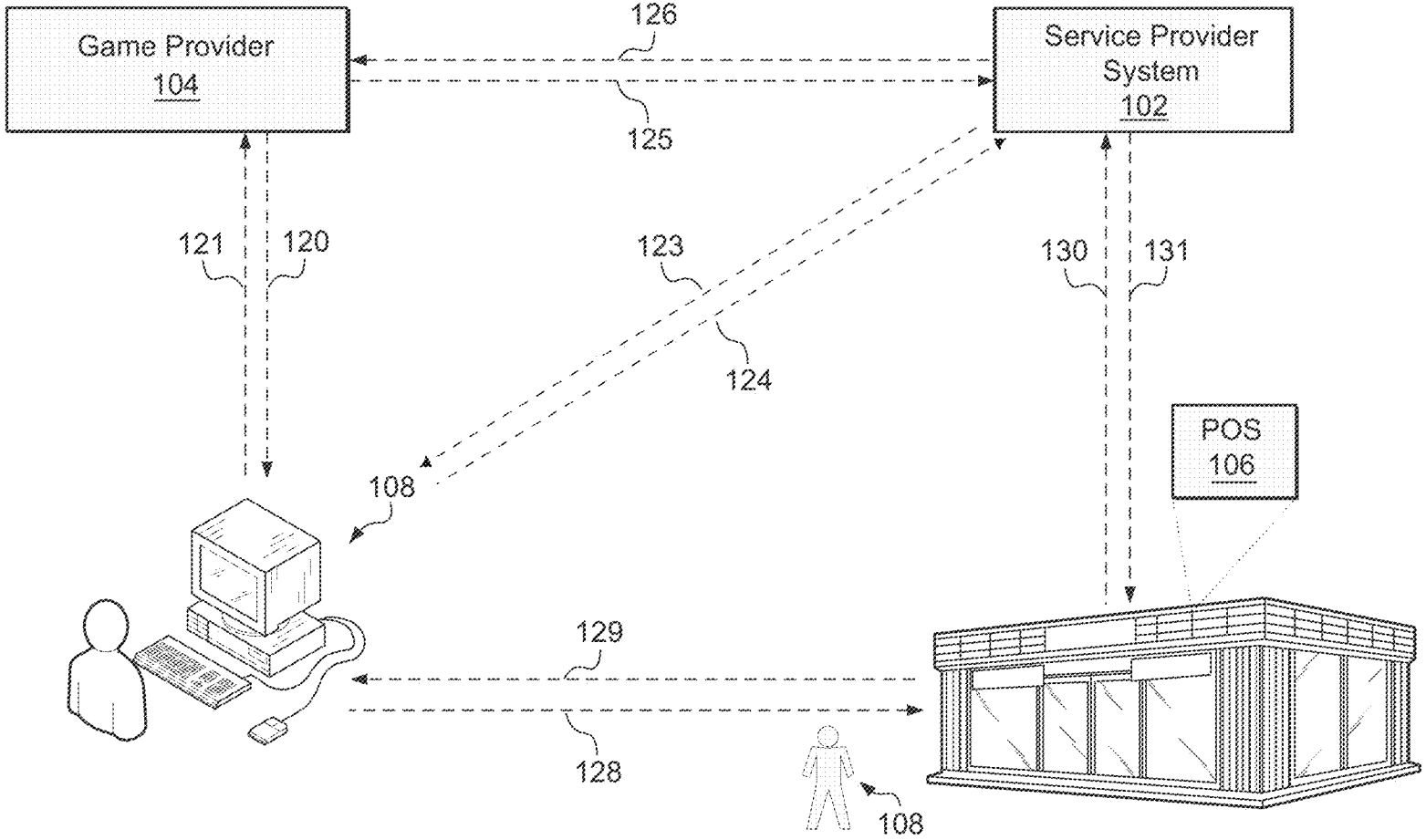
FIG. 1 is a high-level flow process chart illustrating one embodiment of the relationships between the parties involved in the presented systems and methods.

FIG. 1 is a high-level flow illustration of one embodiment showing exemplary relationships between the parties involved in the presented systems and methods. In this embodiment, four parties are involved: (1) a service provider having a service provider system 102; (2) a game provider 104; (3) a point-of-service ("POS") 106; and (4) a game player 108. The dashed lines in FIG. 1 generally represent a flow of information, data, or process or interaction between respective parties. In practice, the dashed lines in FIG. 1 may represent user interfaces and/or application program interfaces (APIs) for the transmission of information, data, instructions, funds, etc. The flow of information, data, or process between the respective parties may be direct or may flow through systems or parties not shown in FIG. 1. In a scenario consistent with FIG. 1, a player 108 wants to make a cash payment to a game provider 104 so that the player can use those funds to play an online game provided by the game provider 104. Making a cash payment to the game provider 104 may be logistically difficult because the game provider 104 is remote from the player 108, because the game provider 104 does not accept cash payments, or because state and federal laws and regulations may limit where payments to the game provider 104 can be made. The service provider system 102 exchanges information with the player 108 and/or the game provider 104. These exchanges are represented by lines 120-121 and 123-126. Based on these exchanges, the service provider system 102 provides a token to the player 108 directly or indirectly (e.g., through the game provider 104). The player 108 presents the token and a payment at the point-of-service 106, which is shown as line 128. The point-of-service 106 communicates with the service provider system 102 to notify the service provider system 102 of the presentment of the token and payment and to transmit funds to the service provider system 102. The interaction between the point-of-service 106 and the service provider system 102 are shown as lines 130 and 131. The point-of-service 106 may interact with the player 108 including by providing information, merchandise, or a token to the player 108. This interaction is shown as line 129.

Figure 2:
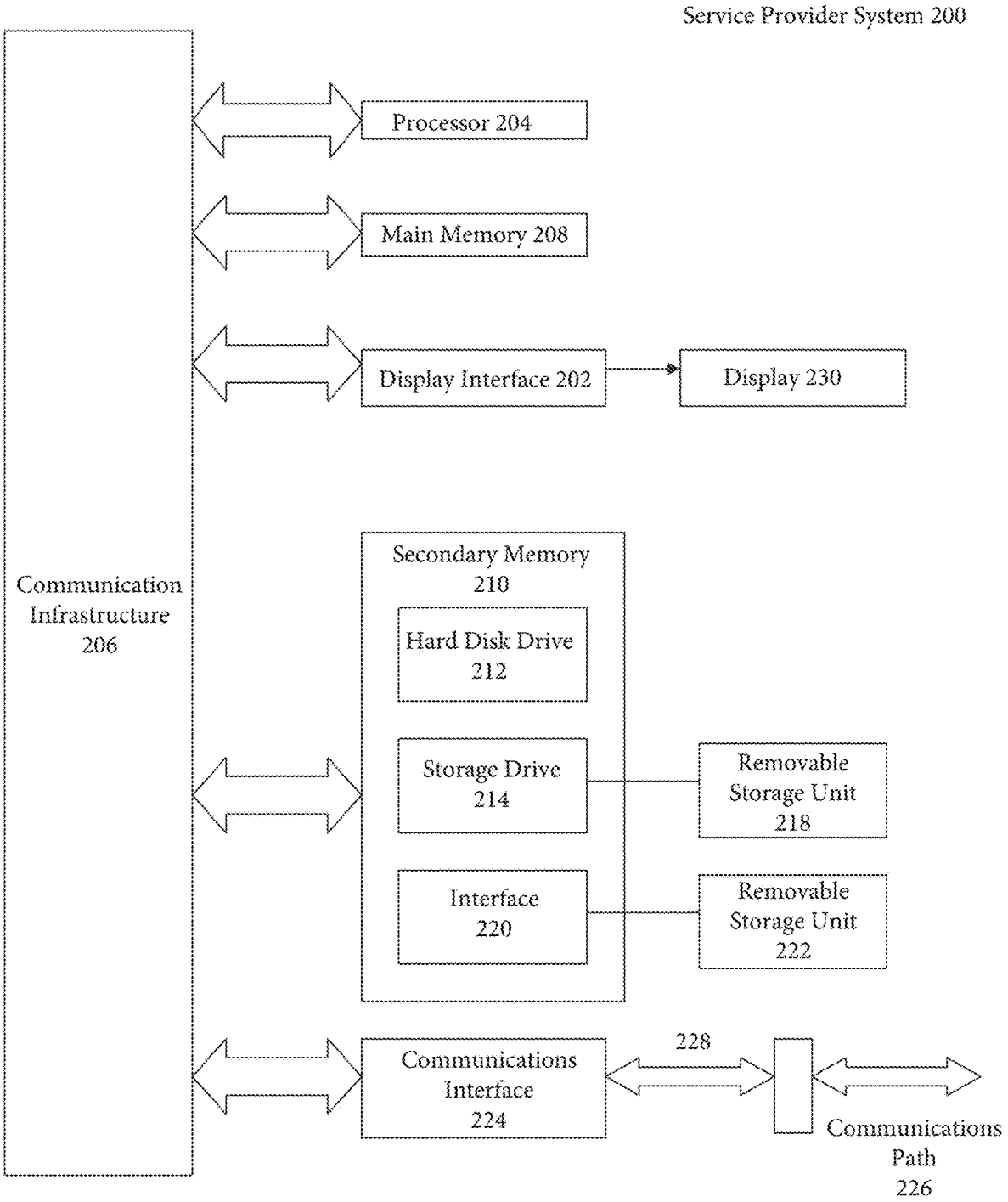
FIG. 2 is a schematic drawing of one embodiment of a service provider system used to implement the methods presented herein.

The service provider system 102 may comprise one or more computer systems capable of carrying out the functionality described herein. For example, FIG. 2 is a schematic drawing of one embodiment of a service provider system 200 used to implement the methods presented herein. Service provider system 200 includes one or more processors, such as processor 204. The processor 204 is connected to a communication infrastructure 206 (e.g., a communications bus, cross-over bar, or network). Computer system 200 can include a display interface 202 that forwards graphics, text, and other data from the communication infrastructure 206 (or from a frame buffer not shown) for display on a local or remote display unit 230.

Service provider system 200 also includes a main memory 208, such as random access memory (RAM), and may also include a secondary memory 210. The secondary memory 210 may include, for example, a hard disk drive 212 and/or a removable storage drive 214, representing a floppy disk drive, a magnetic tape drive, an optical disk drive, flash memory device, etc. The removable storage drive 214 reads from and/or writes to a removable storage unit 218. Removable storage unit 218 represents a floppy disk, magnetic tape, optical disk, flash memory device, etc., which is read by and written to by removable storage drive 214. The removable storage unit 218 includes a computer usable storage medium having stored therein computer software, instructions, and/or data.

In alternative embodiments, secondary memory 210 may include other similar devices for allowing computer programs or other instructions to be loaded into a service provider system 200. Such devices may include, for example, a removable storage unit 222 and an interface 220. Examples of such may include a program cartridge and cartridge interface (such as that found in video game devices), a removable memory chip (such as an erasable programmable read only memory (EPROM), or programmable read only memory (PROM)) and associated socket, and other removable storage units 222 and interfaces 220, which allow computer software, instructions, and/or data to be transferred from the removable storage unit 222 to a service provider system 200.

Service provider system 200 may also include a communications interface 224. Communications interface 224 allows computer software, instructions, and/or data to be transferred between a service provider system 200 and external devices. Examples of communications interface 224 may include a modem, a network interface (such as an Ethernet card), a communications port, a Personal Computer Memory Card International Association (PCMCIA) slot and card, etc. Software and data transferred via communications interface 224 are in the form of signals 228, which may be electronic, electromagnetic, optical, or other signals capable of being transmitted or received by communications interface 224. These signals 228 are provided to and from the communications interface 224 via a communications path (e.g., channel) 226. This channel 226 carries signals 228 and may be implemented using wire or cable, fiber optics, a telephone line, a cellular link, a radio frequency (RF) link, a wireless communication link, and other communications channels.

Computer programs (also referred to as computer control logic) are stored in main memory 208 and/or secondary memory 210. Computer programs may also be received via communications interface 224. Such computer programs, when executed, enable the service provider system 200 to perform the features of the present invention, as discussed herein. In particular, the computer programs, when executed, enable the processor 204 to perform the features of the presented methods. Accordingly, such computer programs represent controllers of the service provider system 200. Where appropriate, the processor 204, associated components, and equivalent systems and sub-systems thus serve as "means for" performing selected operations and functions. Such "means for" performing selected operations and functions also serve to transform a general purpose computer into a special purpose computer programmed to perform said selected operations and functions.

In an embodiment implemented using software, the software may be stored in a computer program product and loaded into a service provider system 200 using removable storage drive 214, interface 220, hard drive 212, or communications interface 224. The control logic (software), when executed by the processor 204, causes the processor 204 to perform the functions and methods described herein.

In another embodiment, the methods are implemented primarily in hardware using, for example, hardware components such as application specific integrated circuits (ASICs). Implementation of the hardware state machine so as to perform the functions and methods described herein will be apparent to persons skilled in the relevant art(s). In yet another embodiment, the methods are implemented using a combination of both hardware and software.

Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing firmware, software, routines, instructions, etc.

Figure 3A:
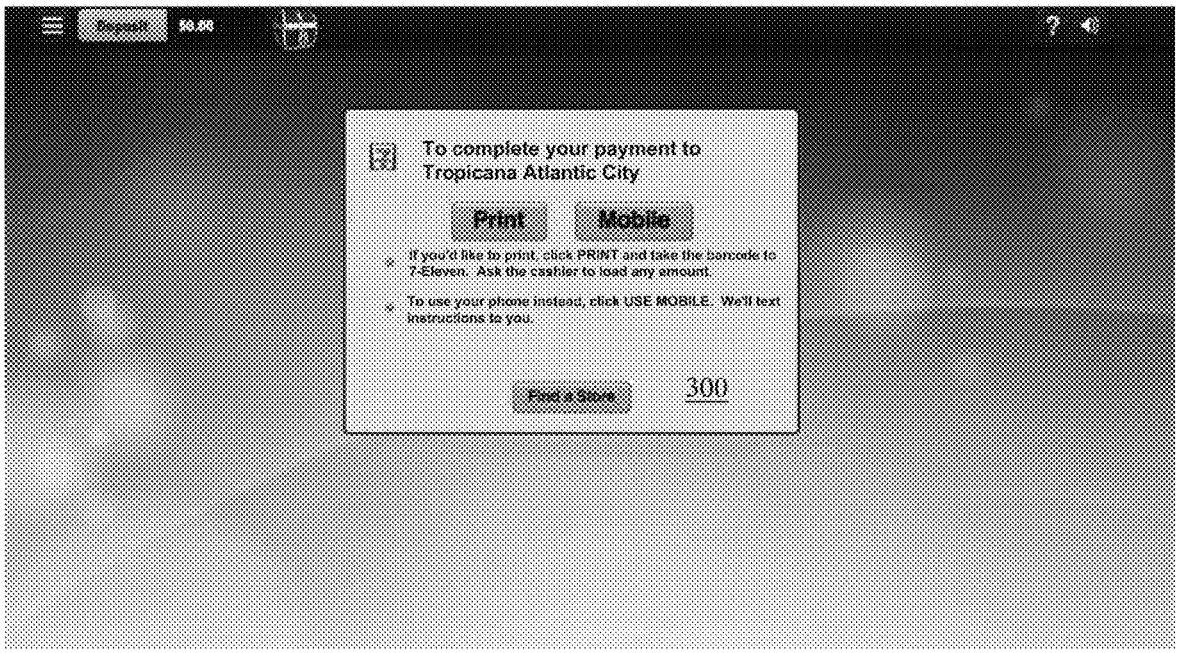
FIGS. 3*a* and 3*b* illustrate embodiments of inline frame elements generated by the service provider system in one of the present invention.
Figure 3B:
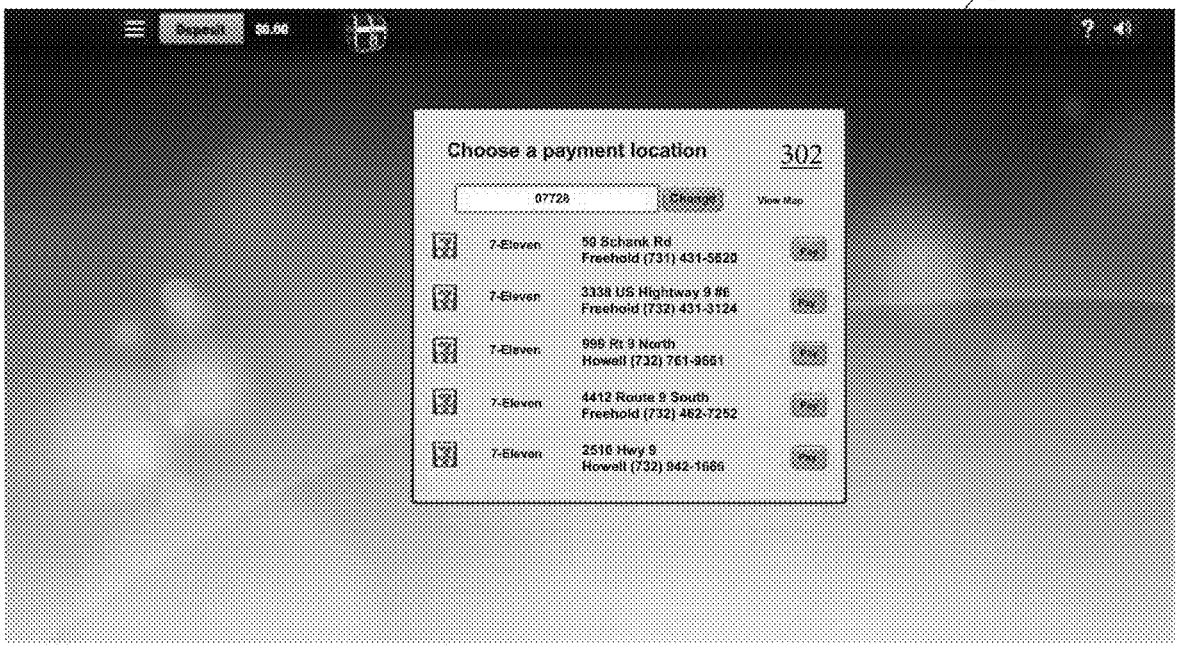

Referring again to FIG. 1, in one embodiment of the present invention, the service provider system 102 facilitates cash payments from a player 108 to a game provider 104. First, the service provider system 102 generates a player input screen for the game provider 104. Generation and transmission of the player input screen may be part of the two-way communication between the service provider system 102 and the game provider 104 shown as lines 125 and 126. Additionally, generation and transmission of the player input screen may be part of the two-way communication between the service provider system 102 and the player 108 shown as lines 123 and 124. The player input screen may appear to the player 108 on a website of the game provider 104 or may be an independent screen provided by the service provider system 102. In one example, the service provider system 102 generates an inline frame element that can be nested or embedded another page such as a game provider's page. FIGS. 3*a* and 3*b* illustrate one embodiment of an inline frame element, 300 and 302, nested or embedded in the page, 301 and 303, of a game provider.

Next, the service provider system 102 receives information about the player 108 via the player input screen. The information may come from directly from the player 108 or from the game provider 104. This player information can include the player's name, address, phone number, or other information that can be used to identify the player. Also, the player information could include a player alias or player identification number. At some point in the interaction between the service provider system 102 and the player 108, the service provider system may present one or more points-of-service 106 to the player 108. The points-of-service 106 may include establishments local to the player 108 that are equipped to accept cash payments. The points-of-service 106 presented to the player 108 may include specific locations (e.g., individual stores) and may include general store information (e.g., a retail chain name) The points-of-service 106 may include retail establishments such as convenience stores, grocery stores, gas stations, and department stores. The points-of-service 106 may also include automated equipment such as automatic teller machines ("ATMs"). The presentation of the points-of-service 106 to the player 108 may be based on the player's information. For example, if the player's information includes an address, the service provider system may 102 may present an address for a point-of-service 106 close to the player's address.

After receiving the player's information, the service provider system 102 generates a token that is a reference to the information the player 108 provided in the player input screen. This token could be an optical machine-readable representation of data like a linear barcode or geometric or two-dimensional barcode. Also, the token could be a number generated by the service provider system 102 that provides a reference to the player information. The token provides sufficient information to correlate a payment made in association with the token to the player 108 that made the payment or for whom the payment was made.

The player 108 may receive the token, for example, on a computer or mobile device. When the player 108 wants to make a payment to the game provider 104, the player 108 takes the token to point-of-service 106 and makes a payment. The point-of-service 106 at which the player 108 makes the payment may be a point-of-service presented to the player 108 by the service provider system 102. The point-of-service 106 receives the token and payment and transmits token information and payment information to the service provider system 102. The service provider system 102 receives the confirmation that the player presented the token and payment. Also, the service provider system 102 receives information about the amount of money the player 108 presented at the point-of-service 106 with the token. The service provider system 102 may send information to the point-of-service 106 in response to the information sent from the point-of-service 106, including an authorization to accept payment from the player 108.

The service provider system 102 also receives a portion of the payment amount received at the point-of-service 104 from the player 108. The amount received by the service provider system 102 may depend on the agreements between the service provider, the game provider, and the point-of-service. For example, the amount received by the service provider system 102 may be less than the amount the player 108 presented to the point-of-service 106 if, for example, the point-of-service 106 retains some of the payment. Alternatively, the amount received by the service provider system 102 may be more than the amount the player 108 presented to the point-of-service 106 if, for example, the point-of-service 106 pays the service provider to increase traffic to the point-of-service.

The service provider, the game provider, and the point-of-service may use a convenience fee model in which a fee is typically visible to the player. In a convenience fee model, the player generally pays any extra costs for the convenience of conducting the transaction. The parties may also use a fixed or variable commission model in which the fee is typically not shown to the customer. In a fixed or variable commission model, costs are typically incurred by the game provider 104. Variable commission can be established between one or more parties, and dependent on one or more factors. For example, a variable commission structure may call for percentages being paid by/to the game provider 104 and/or the point-of-service 106.

The service provider system 102 also transmits a portion of the payment amount received and a portion of the player information to the game provider 104. The game provider 104 uses the player information that the service provider system 102 transmits to correlate the payment it receives with the player 108. The amount received by the game provider 104 may depend on the agreements between the service provider, the game provider, and the point-of-service.

Figure 4:
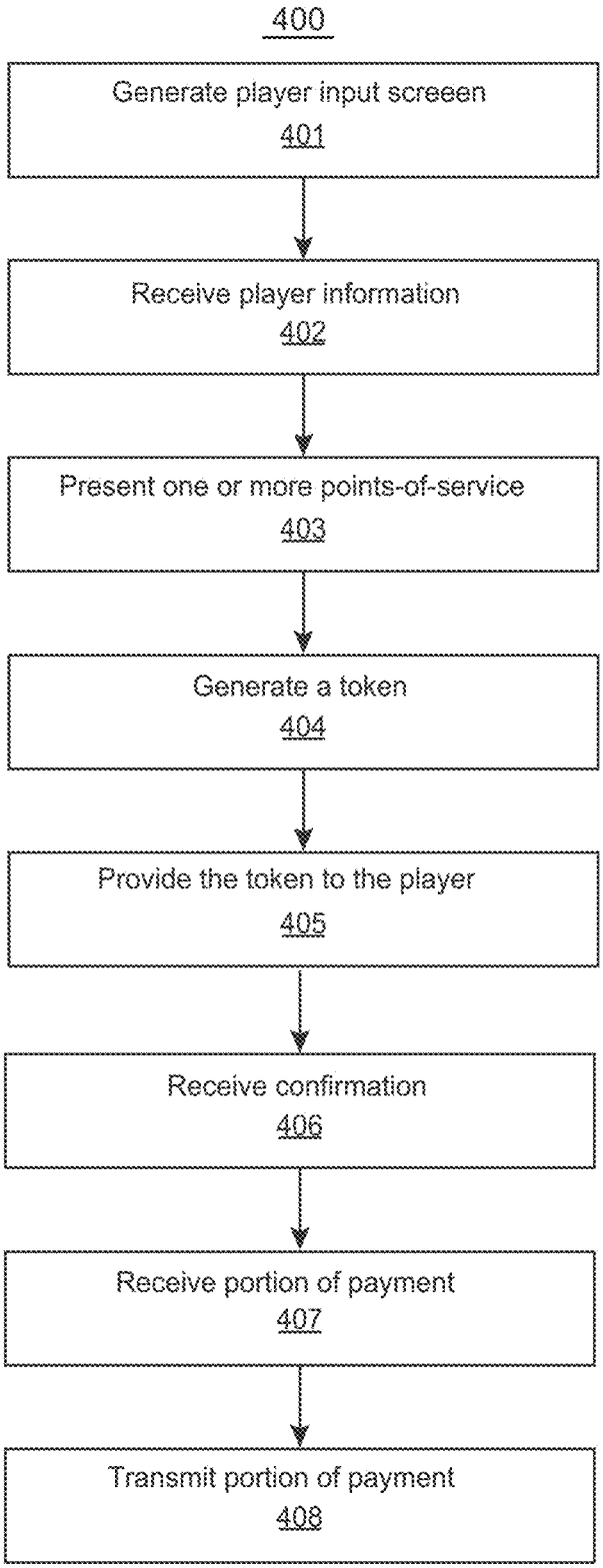
FIG. 4 illustrates one embodiment of a high-level process chart illustrating one aspect of the present invention.

FIG. 4 is a high-level flowchart illustrating one embodiment of a method 400 for facilitating cash payments for gaming as described above. The method includes the service provider system 102; 401 generating a player input screen for a game provider; 402 receiving system information for a player via the player input screen; 403 presenting one or more points-of-service to the player; 404 generating a token that is a reference to the player information; 405 providing the token to the player; 406 receiving a confirmation that the player presented the token and a payment having a payment amount at one of the points-of-service; 407 receiving a first portion of the payment amount received at the point-of-service; and 408 transmitting a second portion of the payment amount received at the point-of-service and a portion of the player information to the game provider.

In another embodiment, the service provider system 102 also receives location information for the point-of-service 106 at which the payment was received and transmits the location information to the game provider 104. The service provider system 102 may receive location information for the point-of-service 106 at which the payment was received and determine if the point-of-service 106 is located in a geographic region authorized to make payments to the game provider 104 based on the location information received. Based on that determination, the service provider system 102 then notifies the point-of-sale 106 to reject the payment from the player if the point-of-service 106 is not located in a geographic region authorized to make payments to the game provider 104. This feature of the present systems and methods is beneficial for assuring compliance with state and federal gaming regulations that may depend on the location at which payment is made or the player's state of residence.

The service provider system 102 may also receive a point-of-service selection from the player and provide a token to the player 108 that further comprises a reference to the point-of-service selection from the player. Also, service provider system 102 may receive a confirmation from the game provider 104 that the game provider received the transmitted second portion of the payment amount and the portion of the player information.

The described systems and methods may also be used to facilitate cash payments to lottery providers. In this case, the game provider 104 is a lottery provider, and the service provider system 102 may receive a selection of lottery numbers from the player 108. Additionally, after receiving a selection of lottery numbers, the service provider system 102 may generate a token that further comprises a reference to the selection of lottery numbers from the player 108. In this case, the token may serve as a receipt of purchase of an entry in a lottery or as a lottery ticket.

In the lottery example, the service provider system 102 may also receive a second confirmation that the player 108 presented the token and a second payment having a second payment amount at one of the points-of-service 106; receive a first portion of the second payment amount received at the point-of-service 106; and transmit a second portion of the second payment amount received at the point-of-service 106 and a portion of the player information. With this aspect of the present systems and methods, a player 108 may re-use the token, play multiple times with the same token, or add payments to an account.

In other embodiments, the service provider system 102 may receive a spending limit associated with the player 108. The service provider system 102 may keep a record of a player's prior payment amounts and then determine if the player's prior payment amounts together with the amount most-recently received at a point-of-service 106 exceeds the spending limit. Also, the service provider system 102 may transmit a notification that the spending limit has been exceeded. The service provider system 102 may send the notification to the point-of-sale 106 and/or instruct the point-of-sale 106 to reject the payment from the player 108 if the service provider system determines that the payment amount together with the prior payment amounts exceed the spending limit.

The service provider system 102 may also receive a spending limit from the game provider 104, from the player 108, or from a government entity. In some embodiments, the spending limit may be temporal, that is, based on a specific time frame. For example, the spending limit may be set by week or by month. That way, the player 108, the game provider 104, or a government entity may set a spending limit for the player 108 for a specific amount of time.

The described systems and methods may also assist in the distribution of winnings to the player 108. The service provider system 102 may receive winnings information from the game provider 104 associated with the player information. The service provider system 102 then distributes funds to the player 108 according to the winnings information and the player information. Further, the service provider system 102 may receive distribution instructions and distribute the funds to multiple accounts according to the distribution instructions.

The described systems and methods may also be used to facilitate cash payments from several players 108 for group gaming. In one embodiment, the service provider system 102 generates a player input screen for a game provider as discussed above. In this instance, the service provider system 102 receives information for a plurality of players 108 via the player input screen. The service provider system 102 may present one or more points-of-service 106 to one of the plurality of players 108. The service provider system 102 further generates a token for each of the plurality of players 108, wherein each token is a reference to the respective player's information. After generating the tokens, the service provider system 102 provides the respective token to each of the players 108. That is, the token corresponding to the information for a player is provided to that player. After the players 108 receive the tokens, they may present the tokens and payment at a point-of-service 106. The service provider system 102 then receives a confirmation from the point-of-service 106 that one or more of the players 108 presented his or her respective token and a payment at the point-of-service 106.

The service provider system 102 also receives information about the payment amount for each player 108 received at the one or more points-of-service 106. Therefore, the service provider system 102 receives information that indicates how much each player who presented his or her token at a point-of-service 106 paid in conjunction with presenting the token. The service provider system 102 then determines a total payment amount received at the one or more points-of-service 106 from the plurality of players 108. The service provider system 102 also receives a portion of the total payment amount received at the point-of-service 106 and transmits a portion of the total payment amount and a portion of the information for the plurality of players received via the player input screen to the game provider 104. The service provider system 102 transmits a portion of the players' information to allow the game provider 104 to link the payments to the players 108.

After transmitting a portion of the player's information to the game provider 104, the service provider system 102 may receive winnings information from the game provider associated with the information. The service provider system 102 then determines an allocation of the winnings among the plurality of players 108 according to the relative payments from each of the plurality of players and distributes funds to the plurality of players according to the allocation. The distribution may take place thorough a point-of-service 106 or thorough other funds distribution channels.

In other embodiments for facilitating cash payments for group gaming, the service provider system 102 generates a player input screen for a game provider 104 and receives information for a player 108 via the player input screen. The service provider system 102 may present one or more points-of-service 106 to the player. The service provider system generates a plurality of tokens that each comprise a reference to the player information and have a unique identifier distinct from the other tokens. The service provider system 102 then provides the plurality of tokens to the player 108. The player may then distribute the tokens to members of a group who wish to participate in the game provider's game. The members of the group who participate in the game also become players 108. In one embodiment, the player selects the game prior to receiving the tokens and the tokens are specific to the selected game. In this embodiment, the members of the group will all participate in the same game. The members who wish to play present the token they received and a payment at a point-of-service 106. After providing the tokens to the player, the service provider system receives a confirmation that at least one of the tokens and a payment having a payment amount were presented at a point-of-service. The service provider system 102 also receives a portion of the payment amount received at the point-of-service 106 and transmits a portion of the payment amount received at the point-of-service and a portion of the player information to the game provider 104.

After transmitting payment and player information to the game provider 104, the service provider system 102 can receive winnings information from the game provider associated with the portion of the player information transmitted to the game provider and determine an allocation of the winnings among the plurality of tokens according to the relative payments made with each token.

In some embodiments, the service provider system 102 receives a request for authorization from a point-of-service 106 and also requests authorization from a game provider 104 before facilitating a cash payment to the game provider. For example, the service provider system 102 can receive an authorization call from a point-of-service 106 and transmit the authorization call to a game provider 104. An authorization call is an electronic request for authorization to receive cash payment from a player 108. After receiving the authorization call, the game provider 104 may provide authorization and additional information to the service provider system 102 including entry numbers associated with one of the game provider's game.

Thereafter, the service provider system 102 receives one or more game entry numbers from the game provider and generates a plurality of tokens that it provides to the player 108. The service provider system 102 then receives a confirmation that at least one of the tokens and a payment having a payment amount were presented at one of the points-of-service 106, receives a portion of the payment amount received at the point-of-service 106, and transmits a portion of the payment amount received at the point-of-service and a portion of the player information to the game provider 104.

In other examples, the service provider system 102 may facilitate cash payments for recurring gaming. In this example, the service provider system generates a player input screen for a game provider and receives information for a player 108 via the player input screen. The service provider system 102 also receives wager information for the player via the player input screen. Wager information may include the amount, timing, as well as the wagered outcome (e.g., winning team, score, and point spread, etc.). As with other embodiments, the service provider system 102 may present one or more points-of-service 106 to the player. The service provider system 102 generates a token that is a reference to the player information and provides the token to the player 108. The player then takes the token to a point-of-service 106 and presents the token and payment. Thereupon, the service provider system 102 receives a confirmation that the player presented the token and payment. The service provider system further receives a portion of the payment amount received at the point-of-service, places a wager with the game provider 104 according to the wager information from the player, and transmits a portion of the payment amount received at the point-of-service and a portion of the player information to the game provider.

In this recurring gaming example, the service provider system 102 may also receive a notification of the outcome of the wager from the game provider 104 and transmit the notification of the outcome of the wager to the player 108. The wager information in the recurring gaming example may comprise a set of numbers that the player 108 wishes to play in a game or the wager information may include a sports team on which the player wishes to wager.

In further embodiments, the service provider system 102 facilitates cash payments for more than one game that may go to more than one game provider. In these embodiments, the service provider system 102 generates a player input screen for a plurality of games of a plurality of game providers 104 and receives information and wager information for a player via the player input screen. The service provider system may present one or more points-of-service to the player 108. The service provider system 102 generates a token that is a reference to the player information and provides the token to the player 108. After the player presents the token and payment at a point-of-service 106, the service provider system receives a confirmation that the player presented the token and a payment, receives a portion of the payment amount received at the point-of-service, places a wager with one or more of the game providers 104 according to the wager information from the player, and transmits a portion of the payment amount received at the point-of-service 106 and a portion of the player information to the one or more game providers 104.

The service provider system 102 for facilitating cash payments for more than one game may also receive a notification of the outcome of the wager from one or more of the game providers 104 and transmit the notification of the outcome of the wager to the player 108. The system 102 may be used to facilitate payments to a plurality lottery providers 104. In this embodiment, the service provider system 102 determines the probability of wining each of the lotteries of the plurality of lottery providers 104 and allocates a portion of the payment amount according to the probability of wining each of the lotteries. Further, the service provider system 102 may determine the payoff amount for each of the lotteries of the plurality of lottery providers 104 and allocate a portion of the payment amount according to the payoff amount for each of the lotteries. In each of these examples, the player 108 may have the option to indicate which lotteries the service provider system will include in its determination and the player 108 may indicate the criteria (e.g., highest probability of wining or highest payoff amount) that the service provider system 102 will use to determine how to allocate the payment.

The service provider system 102 of the present invention may also be configured in other ways to facilitate cash payments for lottery and raffle type games. In one example, the service provider system 102 generates a game-provider input screen and receives information for a game provider 104 via the game-provider input screen. The information may include information about the identity of the game provider and information about a game of the game provider. The service provider system 102 may present one or more points-of-service 106 to the game provider. The service provider system 102 generates a primary token that comprises a first reference to the game provider information and provides the primary token to the game provider 104. The game provider 104 may then distribute the primary token to people who wish to play a game associated with the token. The players 108 who have received the primary token may then present the primary token and payment at a point-of-service 106. At this point, the service provider system 102 receives a confirmation that the primary token and a payment were presented at a point-of-service 106 and generates one or more secondary tokens based on the amount of the payment presented. Each secondary token also comprises a reference to the game provider information. The service provider system 102 then provides the secondary tokens to the point-of-service 106 at which the payment was presented, receives a portion of the payment amount received at the point-of-service, and transmits a portion of the payment amount received at the point-of-service to the game provider 104. The point-of-service 106 provides the secondary tokens to the player 108 or players who presented the primary token and payment.

In this embodiment, the game provider 104 may be a lottery provider, and the service provider system 102 may also receive a selection of lottery numbers from the player 108. In this example, the service provider system 102 may generate secondary tokens that comprise a reference to the selection of lottery numbers from the player 108. The secondary tokens that comprise a reference to the selection of lottery numbers may serve as receipts of purchase of one or more entries in the lottery.

The service provider system embodiment that provides secondary tokens may also receive a game denomination amount from the game provider 104 and determine whether the payment amount received at the point-of-service 106 corresponds to a multiple of the game denomination amount. Based on that determination, the service provider system 102 transmits a notification to the point-of-service 106. This embodiment is useful, for example, to a game provider 104 who wants to provide tickets for a game that have a set denomination (e.g. $5 per ticket). When a player 108 presents a cash payment that is a multiple of the set denomination (e.g., $10), the service provider system 102 may notify the point-of-service 106 to accept the payment and issue tickets (e.g., 2 tickets). If the player 108 presents a cash payment that is not a multiple of the set denomination (e.g., $4), the service provider system 102 may notify the point-of-service 106 to reject the payment and/or provide a message to the player 108.

The service provider system 102 embodiment that provides secondary tokens may also receive a confirmation that one of the secondary tokens was presented at one of the points-of-service 106, receive winnings information from the game provider 104 associated with the secondary token presented at the point-of-service 106, and transmit the winnings information to the point-of-service 106 at which the secondary token was presented.

Figure 5:
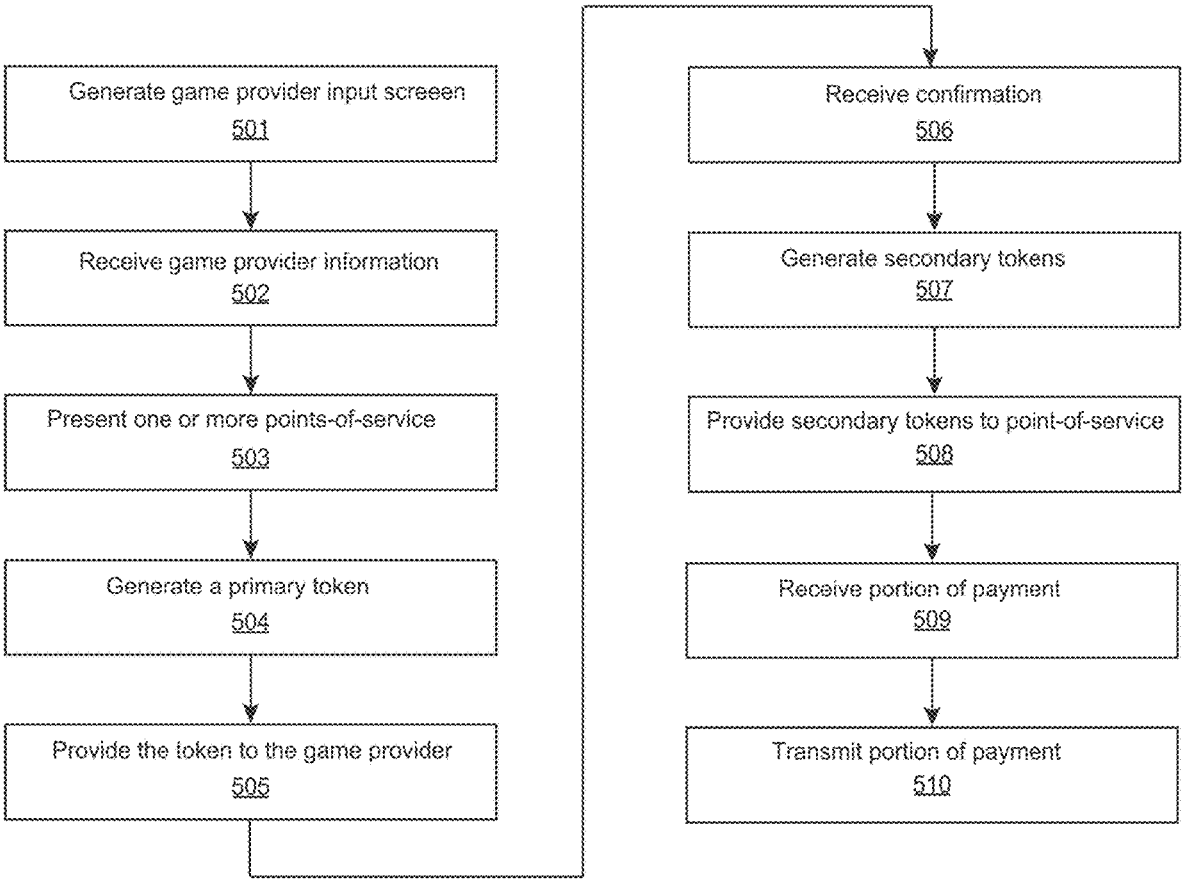
FIG. 5 illustrates one embodiment of a high-level process chart illustrating one aspect of the present invention.

FIG. 5 is a high-level flowchart illustrating one embodiment of a method 500 for facilitating cash payments for gaming using a service provider system that provides secondary tokens as described above. The method includes the service provider system: 501 generating a game-provider input screen; 502 receiving information for a game provider via the game-provider input screen; 503 presenting one or more points-of-service to the game provider; 504 generating a primary token that comprises a first reference to the game provider information; 505 providing the primary token to the game provider; 506 receiving a confirmation that the primary token and a payment having a payment amount were presented at one of the points-of-service; 507 generating one or more secondary tokens based on the payment amount that each comprise a second reference to the game provider information; 508 providing the one or more secondary tokens to the point-of-service at which the payment was presented; 509 receiving a first portion of the payment amount received at the point-of-service; and 510 transmitting a second portion of the payment amount received at the point-of-service to the game provider.

The figures included herein serve as embodiments of the presented systems and methods. Each individual process or sub-process performed within the embodiments described can be performed by one or more parties, as well as one or more computer systems. For example, in one embodiment, some or all of the communications and data transfers between game provider, service provider system, and point-of-service are performed via an automated computer-based system, such as an application program interface. As such, the embodiments presented in the figures are not intended to be limiting.

What is claimed is:

1. A method to facilitate transactions with a game provider, the method comprising:

generating an input element for a player input screen at a service provider system, the input element representing a proposed transaction to provide a game from the game provider to a player system;

sending the input element to the game provider to be included in the player input screen that is sent to the player system by the game provider;

receiving a player information about the player of the player system at the service provider system through the input element of the player input screen presented on the player system;

presenting information regarding a point-of-service to the player system from the service provider system based on the player information, the point-of-service being equipped to accept cash payments;

generating a token that is optically readable for use by the point-of-service, the token being linked to the player information;

providing the token to the player system from the service provider system;

determining if the point-of-service is located in a geographic region authorized to make game payments to the game provider;

notifying the point-of-service to reject the game payments from the player system if the point-of-service is not located in the geographic region authorized to make the game payments from the player system to the game provider;

receiving a token information, a payment information and a confirmation that the player presented the token and a transaction payment from the point-of-service at the service provider system if the point-of-service is located in the geographic region authorized to make the game payments from the player system to the game provider, the confirmation indicating that the player has provided the transaction payment to the point-of-service; and sending the player information and the payment information from the service provider system to the game provider in response to receiving the confirmation to indicate completing the proposed transaction to the game provider.

2. The method of claim 1, wherein the input element is configured to be nested in a frame of a game provider page having the player input screen.

3. The method of claim 1, wherein the game provider page is within a game provider website.

4. The method of claim 1, wherein receiving the player information includes receiving location information of the player, the method further comprising selecting the point-of-service from among a plurality of points-of-service that are local to the player, before presenting information regarding the point-of-service.

5. The method of claim 4, wherein determining if the point-of-service is located in the geographic region authorized to make the game payments to the game provider is performed based on the received location information.

6. The method of claim 1, wherein the token indicates a game selection from the player system and wherein the game selection is received at the service provider system from the player system before generating the token.

7. The method of claim 1, wherein the token comprises a reference to the point-of-service.

8. The method of claim 1, further comprising receiving a selection of the point-of service from the player system before presenting the information about the point-of-service.

9. The method of claim 1, further comprising, if the point-of-service is located in the geographic region authorized to make the game payments from the player system to the game provider, sending an authorization from the service provider system to the point-of-service to accept the transaction payment from the player for the token in response to receiving the token information and the payment information and before receiving the transaction payment from the player.

10. The method of claim 9, further comprising requesting and receiving the authorization from the game provider before sending the authorization to the point-of-sale.

11. The method of claim 1, further comprising:

receiving a spending limit associated with the player at the service provider system;

storing prior payment amounts associated with the player at the service provider system;

storing a payment amount of the transaction payment received at the point-of-service at the service provider system;

determining if the payment amount together with the prior payment amounts exceed the spending limit; and transmitting from the service provider system to the point-of-service a notification that the spending limit has been exceeded if the service provider system determines that the payment amount together with the prior payment amounts exceed the spending limit.

12. The method of claim 11, wherein receiving the spending limit comprises receiving the spending limit from the game provider.

13. The method of claim 1, further comprising;

receiving a second payment from the point-of-service at the service provider system, the second payment being less than the transaction payment; and sending a third payment from the service provider system to the game provider, the third payment being less than the second payment.

14. A non-transitory machine-readable medium comprising instructions stored thereon that, when operated on by a machine, cause the machine to perform operations to facilitate transactions with a game provider, the operations comprising:

generating an input element for a player input screen at a service provider system, the input element representing a proposed transaction to provide a game from the game provider to a player system;

sending the input element to the game provider to be included in the player input screen that is sent to the player system by the game provider;

receiving a player information about the player of the player system at the service provider system through the input element of the player input screen presented on the player system;

presenting information regarding a point-of-service to the player system from the service provider system based on the player information, the point-of-service being equipped to accept cash payments;

generating a token that is optically readable for use by the point-of-service, the token being linked to the player information;

providing the token to the player system from the service provider system;

determining if the point-of-service is located in a geographic region authorized to make game payments to the game provider;

notifying the point-of-service to reject the game payments from the player system if the point-of-service is not located in the geographic region authorized to make the game payments from the player system to the game provider;

receiving a token information, a payment information and a confirmation that the player presented the token and a transaction payment from the point-of-service at the service provider system if the point-of-service is located in the geographic region authorized to make the game payments from the player system to the game provider, the confirmation indicating that the player has provided the transaction payment to the point-of-service; and sending the player information and the payment information from the service provider system to the game provider in response to receiving the confirmation to indicate completing the proposed transaction to the game provider.

15. The medium of claim 14, the operations further comprising:

receiving multiple game entry number selections from the player system;

requesting authorization from the game provider for the game entry number selections;

receiving the requested authorization from the game provider, wherein generating the token comprises generating the token for each game entry number selection.

16. The medium of claim 15, the operations further comprising:

receiving winnings information from the game provider associated with the player information;

determining an allocation of winnings to the player based on past payments received from the player; and distributing funds to the player according to the determined allocation.

17. A service provider system to facilitate transactions with a game provider, the service provider system comprising:

a processor to generate an input element, the input element representing a proposed transaction to provide a game from a game provider to a player system; and a communications interface to send the input element to the game provider to be included in the player input screen that is sent to the player system by the game provider, to receive a player information about the player of the player system through the input element, to present information regarding a point-of-service to the player system based on the player information, the point-of-service being equipped to accept cash payments;

the processor further to generate a token for use by the point-of-service, the token being linked to the player information and provided to the player system through the communications interface, to determine if the point-of-service is located in a geographic region authorized to make game payments to the game provider, and to notify the point-of-service to reject the game payments from the player system if the point-of-service is not located in the geographic region authorized to make the game payments from the player system to the game provider;

the communications interface further to receive a token information, a payment information and a confirmation that the player presented the token and a transaction payment from the point-of-service at the service provider system, if the point-of-service is located in the geographic region authorized to make the game payments from the player system to the game provider, the confirmation indicating that the player has provided the transaction payment to the point-of-service, and to send the player information and the payment information to the game provider in response to receiving the confirmation to indicate completing the proposed transaction to the game provider.

18. The service provider system of claim 17, wherein the communications interface is further to receive a spending limit associated with the player and to transmit to the point-of-service a notification that the spending limit has been exceeded, the service provider system further comprising a secondary memory to store prior payment amounts associated with the player and to store a transaction payment amount received at the point-of-service, wherein the processor is further to determine if the transaction payment amount together with the prior payment amounts exceed the spending limit to cause transmitting the notification if the service provider system determines that the transaction payment amount together with the prior payment amounts exceeds the spending limit.

19. The service provider system of claim 17, wherein receiving the player information includes receiving location information of the player, and wherein the processor is further to select the point-of-service from among a plurality of points-of-service that are local to the player, before presenting information regarding the point-of-service.

20. The service provider system of claim 19, wherein determining if the point-of-service is located in the geographic region authorized to make the game payments to the game provider is performed based on the received location information.

* * * * *